United States Patent [19]

Várkonyi et al.

[11] 4,013,335

[45] Mar. 22, 1977

[54] LAMP CAPS FOR HALOGEN LAMPS AND THE LIKE

[75] Inventors: László Várkonyi; György Szabó; József Ortó; László Nagy; János Spielmann; György Rabatin; István Pozsonyi, all of Budapest, Hungary

[73] Assignee: Egyesult Izzolampa Es. Villamossagi Resveny tarsasag, Budapest, Hungary

[22] Filed: July 2, 1975

[21] Appl. No.: 592,793

[30] Foreign Application Priority Data

July 3, 1974 Hungary ..... EE 2251

[52] U.S. Cl. ..... 339/144 R; 313/318

[51] Int. Cl.² ..... H01J 5/56

[58] Field of Search ..... 339/144, 145; 29/25.13; 313/318

[56] References Cited

UNITED STATES PATENTS 3,739,221 6/1973 De Bleyker et al. ..... 339/144 R 3,963,916 6/1976 Morton ..... 339/144 T X

FOREIGN PATENTS OR APPLICATIONS 1,022,007 3/1966 United Kingdom ..... 313/318

*Primary Examiner*—Roy Lake
*Assistant Examiner*—E. F. Desmond

[57] ABSTRACT

An improved construction for a lamp cap suitable for interconnecting the elongated constricted neck of a halogen lamp to an electrode-bearing lamp holder is described. A hollow elongated deformable insert is coaxially positioned within a conventional cover disc of the lamp cap. The interior dimension of the insert is chosen to effect a secure frictional engagement with at least 30% of the length of the constricted lamp neck, and is permanently or removably affixed to the surrounding cover disc. The lamp holder may then be affixed to the composite lamp cap to complete the assembly.

10 Claims, 3 Drawing Figures

LAMP CAPS FOR HALOGEN LAMPS AND THE LIKE

BACKGROUND OF THE INVENTION

The invention relates to lamp caps having a cover disc for interconnecting the elongated constricted neck of a halogen lamp to an electrode-bearing lamp holder assembly engageable with such cover disc.

In order to effect a secure connection between certain types of high temperature lamps (e.g., halogen lamps used for automotive applications) and the associated lamp holder assembly which contains electrodes for receiving energizing power for the lamp from the automobile battery or generator system, a lamp cap having a cover disc is conventionally employed. In order to facilitate an efficient electrical and mechanical interconnection between the lamp and the holder through the cap, the neck of the lamp is pinched or constricted to define a substantially rectangular cross-section of reduced area.

Illustratively, the circular interior of the cover disc of the lamp cap is designed to engage the edges of the rectangular neck of the lamp, with a conductive cement being interposed in the interstices between the outer periphery of the neck and the inner periphery of the lamp to assure conductivity. The electrode-bearing lamp holder is then fitted into the assembled lamp and cap.

One disadvantage of lamp cap connections of this type is the necessity of employing expensive conductive cements capable of resisting the extremely high temperatures generated during operation of halogen lamps of this type. Further stresses on the assembly, and particularly on the cemented portion thereof, occur because of the effects of humidity, shock, and other forces common in the operating environments of the lamp. Consequently, it has been found difficult to obtain reliable interconnection between halogen lamps and the associated lamp holders on a mass-production basis.

SUMMARY OF THE INVENTION

The present invention avoids these disadvantages by providing an improved lamp cap assembly having a cover disc for interconnecting an elongated, constricted neck of a lamp to an electrode-bearing lamp holder assembly engageable with the disc.

In the improved construction, the lamp cap further includes an elongated, hollow deformable conductive insert that is coaxially positionable inside the cover disc to effect frictional engagement with the periphery of the constricted lamp neck over at least 30% of its length.

Suitable means are provided for conductively interconnecting the deformable insert with the surrounding cover disc. In one embodiment, the sleeve if provided with a plurality of spaced, parallel slits that extend axially along the peripheral wall from one end surface thereof, with the portion of the sleeve defined between two adjacent ones of the slits being bent outwardly to form lugs which in turn are engageable with the surrounding cover disc. If desired, the insert and the cover disc may be formed as a unitary assembly.

In the case where the constricted cross-section of the lamp neck is substantially rectangular, the cross-section of the insert illustratively is formed as a circle having a maximum diameter that amounts to 95% of the diagonal dimension of the rectangular neck cross-section. The resulting firm frictional engagement of the insert with the lamp neck is particularly advantageous because of the inevitable irregularities in the outer periphery of the neck; for example, the resiliency of the neck automatically conforms to the irregularities in the neck cross-section, leading to a secure electrical and mechanical interconnection.

BRIEF DESCRIPTION OF THE DRAWING

The invention is further set forth in the following detailed description taken in conjunction with the appended drawing, in which.

DETAILED DESCRIPTION

Figure 1:
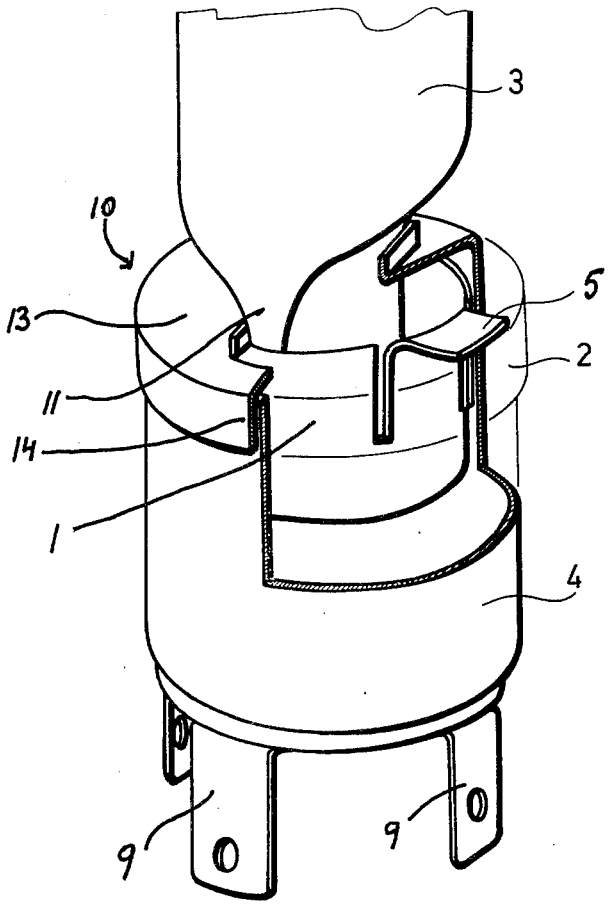
FIG. 1 is a perspective elevation view, partly broken away, of a composite lamp cap constructed in accordance with the invention, said cap being shown in operative relationship with the constricted neck of a halogen lamp and with an associated electrode-bearing lamp holder.

Referring now to the drawing, 3 represents a conventional halogen lamp of the type suitable for use in automotive applications. The lamp 3 is provided with an elongated constricted neck portion 11, which is illustratively of rectangular cross-section.

Electrical power for energizing the lamp is obtainable via a plurality of electrodes 9—9 secured to the base of a conventional lamp holder 4. Electrical and mechanical interconnection between the lamp 3 and the lamp holder 4 is provided by a lamp cap assembly 10, which illustratively includes a conductive cover disc 2 disposed in surrounding relation to the neck portion 11 of the lamp 3.

In accordance with the invention, the cap assembly 10 is provided with facilities for assuring a more secure electrical and mechanical connection between lamp and lamp holder than that provided with the use of conventional conductive cements. In particular, the cap assembly 10 further includes an elongated, hollow deformable insert 1, which is arranged to fit over at least 30% of the length of the elongated lamp neck portion 11 and which has a cross-section selected to provide a tight frictional engagement with the outer periphery of the portion 11.

Figure 2:
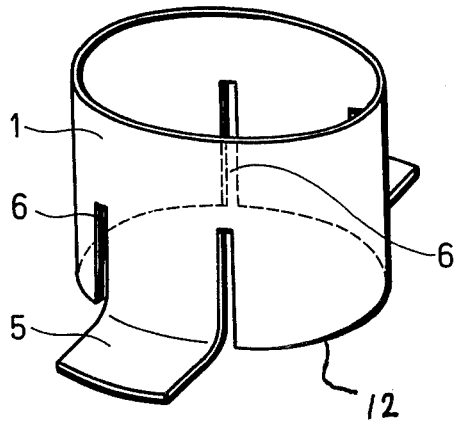
FIG. 2 is a perspective view of an elongated deformable insert forming a portion of the lamp cap of FIG. 1.

In order to secure the sleeve 1 to the surrounding cover disc 2, the insert may be illustratively constructed in a manner shown in FIG. 2. In particular, the insert is formed as a circular cylinder having a plurality of parallel slits 6—6 extending axially from one end surface 12 thereof. The portion of the sleeve 1 defined between opposed pairs of the slits 6,6 are bent outwardly to form lugs 5,5, which overlap a flat top surface 13 of the cover disc 2 (FIG. 1). The slits 6 additionally serve to provide the required springiness or "give" of the metallic sleeve 1.

In the arrangement shown in FIG. 1, the sleeve is affixed to the cover disc 2 by suitably securing the outwardly extending lugs 5,5 to the surface 13 of the cover plate, as by soldering or welding. In order to complete the assembly of the lamp to the lamp holder, the holder 4 may be suitably secured, as represented at 14, to the inner surface of the cover disc 2, as by soldering or welding.

As indicated before, the length of the insert 1 is selected such when it is pulled on over the constricted neck 11 of the lamp 3, it occupies at least 30% of the length of the neck. Additionally, when the insert 1 exhibits the circular cross-section shown in FIG. 2, its normal inside diameter is selected to be a maximum of 95% of the diagonal dimension of the rectangular cross-section of the lamp neck 11.

If desired, the interior cross-section of the insert 1 may define a closed surface other than a circular cylinder. In any case, the presence of the slits 6 assure sufficient conformity between the insert 1 and the neck 11 to accommodate the inevitable irregularities occurring in the manufacture of the constricted lamp neck.

Figure 3:
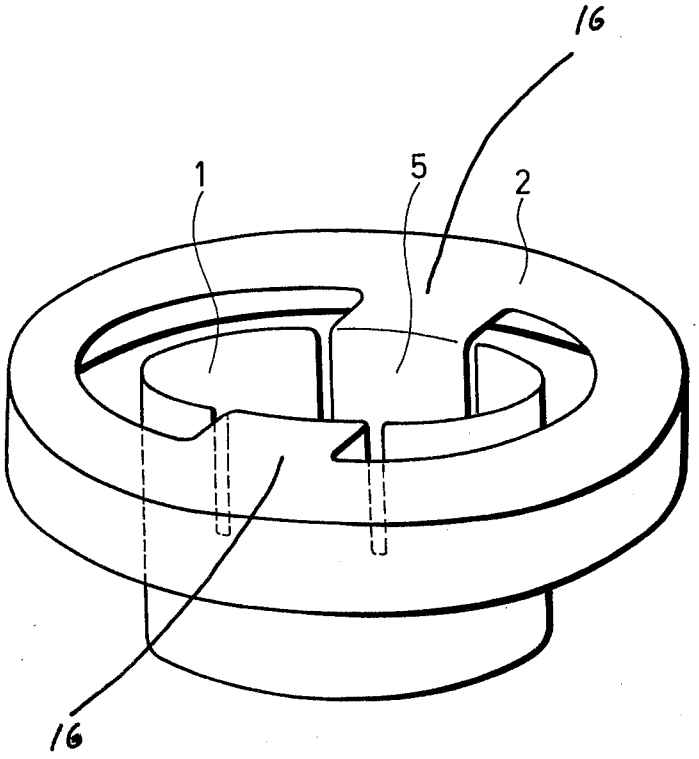
FIG. 3 is a perspective view of a unitary assembly of a deformable insert and a surrounding cover disc collectively forming a lamp cap in accordance with the invention.

The composite lamp cap 10 in accordance with the invention may be formed as a unitary assembly, rather than exhibit the two-piece construction shown in FIG. 1. Such unitary assembly is illustrated in FIG. 3, whereby the top surface 10 of the cover disc 2 exhibits a pair of inwardly extending projections or ribs 16—16 which coincide with the lugs 5 defined between adjacent ones of the slits 6 of the insert 1. In such case, the projections 16 are coplanar with the surface 10, as contrasted with the arrangement of FIG. 1, wherein the separate lugs 5 overlap the surface 10. In all other respects, the arrangement of FIG. 3 corresponds in structure and function with that of FIG. 1.

In the foregoing, several embodiments of the invention have been described. Many variations and modifications will now occur to those skilled in the art. It is accordingly desired that the scope of the appended claims not be limited to the specific disclosure herein contained.

What is claimed is:

1. In a lamp cap for interconnecting an elongated, constricted neck of a lamp to an electrode-bearing lamp holder, a cover disc overlying the lamp neck and engageable with the lamp holder, the cover disc having a radially inwardly extending flange on an inner end thereof, an elongated, hollow deformable insert positionable inside and coaxially with the cover disc for frictional engagement with the periphery of the lamp neck, and means for affixing the insert to the cover disc, the improvement in which the sleeve has a plurality of circumferentially spaced parallel slits extending axially along its peripheral wall from the inner end thereof; in which the insert includes an integral lug extending radially outwardly from the inner end of at least one portion of the sleeve located between adjacent ones of the slits; and in which the affixing means comprises means for engaging the lug with the flange of the cover disc.

2. Apparatus as defined in claim 1, in which the length of the insert is at least 30% of the length of the lamp neck.

3. Apparatus as defined in claim 1, in which the affixing means are adapted to removably connect the insert to the cover disc.

4. Apparatus as defined in claim 1, in which the cross-section of the lamp neck is substantially rectangular.

5. Apparatus as defined in claim 4, in which the cross-section of the insert defines a circle whose maximum diameter is 95% of the diagonal dimension of the rectangular cross-section of the lamp neck.

6. Apparatus as defined in claim 1, in which the cross-section of the insert defines a closed curve other than a circle.

7. As a new article of manufacture, a unitary lamp cap adapted to interconnect a constricted lamp neck to an electrode-bearing lamp holder, said cap comprising a cover disc adapted to receive the holder and having a radially inwardly extending flange on an inner end thereof, and an elongated, hollow deformable insert disposed interiorly of and substantially coaxially with the cover disc for frictionally engaging the constricted lamp neck, the insert having a plurality of spaced axial slits extending along its peripheral wall from the inner end thereof and an integral lug extending radially outwardly from the inner end between a pair of adjacent slits to terminate at the flange on the cover disc.

8. An article as defined in claim 7, in which the length of the insert is at least 30% of the length of the constricted neck.

9. In a method of securing a lamp cap having a cover disc to an elongated constricted lamp neck of substantially rectangular cross-section, the improvement which comprises frictionally engaging at least 30% of the length of the constricted neck with a hollow, elongated deformable circular insert disposed interiorly of the cover disc, and having an integral lug extending radially outwardly from the inner end thereof to engage the flange on the cover disc.

10. A method as defined in claim 9, in which the maximum internal diameter of the insert is 95% of the diagonal dimension of the rectangular cross-section of the lamp neck.

* * * * *